US009158266B2

(12) United States Patent
Satoh et al.

(10) Patent No.: US 9,158,266 B2
(45) Date of Patent: Oct. 13, 2015

(54) WASTE TONER CONVEYING DEVICE AND IMAGE FORMING APPARATUS USING THE SAME

(71) Applicants: Atsushi Satoh, Kanagawa (JP); Fumihito Itoh, Kanagawa (JP); Tomohiko Saito, Kanagawa (JP); Takamichi Orikasa, Kanagawa (JP)

(72) Inventors: Atsushi Satoh, Kanagawa (JP); Fumihito Itoh, Kanagawa (JP); Tomohiko Saito, Kanagawa (JP); Takamichi Orikasa, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 14/107,430

(22) Filed: Dec. 16, 2013

(65) Prior Publication Data

US 2014/0169852 A1 Jun. 19, 2014

(30) Foreign Application Priority Data

Dec. 18, 2012 (JP) ..... 2012-275650

(51) Int. Cl.
*G03G 21/10* (2006.01)

(52) U.S. Cl.
CPC ..... *G03G 21/105* (2013.01)

(58) Field of Classification Search
CPC ..... G03G 21/105; G03G 21/10; G03G 21/12
See application file for complete search history.

(56) References Cited

U.S. PATENT DOCUMENTS 6,112,046 A * 8/2000 Suzuki et al. ..... 399/359
7,333,763 B2 * 2/2008 Choi ..... 399/358
8,270,892 B2 * 9/2012 Kawai ..... 399/395
2002/0064408 A1 5/2002 Akiba et al.
2003/0170049 A1 9/2003 Itoh et al.
2006/0062614 A1 * 3/2006 Choi ..... 399/358
2008/0193161 A1 8/2008 Sano et al.
2008/0298845 A1 * 12/2008 Ohmura et al. ..... 399/254
2008/0317484 A1 * 12/2008 Tanimoto et al. ..... 399/35
2009/0022532 A1 * 1/2009 Fukunaga et al. ..... 399/360
2009/0052963 A1 * 2/2009 Kawai ..... 399/395
2009/0067873 A1 * 3/2009 Gunbe ..... 399/99
2009/0252526 A1 * 10/2009 Kadowaki ..... 399/99
2010/0080600 A1 4/2010 Okamoto et al.
2010/0290815 A1 * 11/2010 Ichikawa et al. ..... 399/254
2011/0052225 A1 3/2011 Honjoh et al.

(Continued)

FOREIGN PATENT DOCUMENTS

JP 2001-147629 5/2001

OTHER PUBLICATIONS

Machine Translation of JP 2001147629.*

(Continued)

*Primary Examiner* — Clayton E Laballe
*Assistant Examiner* — Ruifeng Pu
(74) *Attorney, Agent, or Firm* — Harness, Dickey & Pierce, P.L.C.

(57) ABSTRACT

A waste toner conveying device for conveying waste toner removed from an image carrier to a waste toner container includes a waste toner conveying path including at least a falling and conveying path for letting the waste toner fall under its own weight; a toner bridging prevention member configured to move in the falling and conveying path to prevent bridging of the waste toner; a drive source configured to drive the toner bridging prevention member; a drive transfer member configured to transfer a driving force from the drive source to the toner bridging prevention member; and a toner adhesion prevention member configured to prevent the waste toner from adhering to the drive transfer member.

16 Claims, 5 Drawing Sheets

(56) References Cited

U.S. PATENT DOCUMENTS

2012/0070195 A1* 3/2012 Ichikawa et al. ..... 399/254
2012/0237230 A1* 9/2012 Karasawa et al. ..... 399/35
2013/0164003 A1* 6/2013 Aoshima et al. ..... 399/35
2014/0270860 A1* 9/2014 Asai ..... 399/283

OTHER PUBLICATIONS

Machine Translation of JP 2001147629 dated Nov. 22, 1999.*

* cited by examiner

WASTE TONER CONVEYING DEVICE AND IMAGE FORMING APPARATUS USING THE SAME

CROSS-REFERENCE TO RELATED APPLICATION

The present application claims priority to and incorporates by reference the entire contents of Japanese Patent Application No. 2012-275650 filed in Japan on Dec. 18, 2012.

BACKGROUND OF THE INVENTION

1. Field of the Invention

The present invention relates to a waste toner conveying device, and an image forming apparatus using the waste toner conveying device.

2. Description of the Related Art

Conventional image forming apparatuses with image carriers such as a photosensitive element and an intermediate transfer element, include a cleaning device that collects residual waste toner on the image carriers. Waste toner collected by the cleaning device is conveyed to a waste toner container by a waste toner conveying device provided in the apparatus main body separately from the cleaning device.

Some of waste toner conveying devices conveys toner through a conveying path including a falling and conveying path for falling waste toner under its own weight. However, in such a waste toner conveying device, in particular in hot and humid conditions, waste toner having passed through the falling and conveying path is prone to adhere to the inner wall of a housing constituting the falling and conveying path, and over time the waste toner coagulates and gradually accumulates. Thus, the accumulated waste toner gradually clogs the falling and conveying path, that is, so-called toner bridging occurs, which interferes with collection of waste toner.

Japanese Patent No. 3893232 suggests a waste toner conveying device in which a thin plate-like swing member is provided along one side surface of inner wall surfaces of a housing constituting a falling and conveying path. In the waste toner conveying device, swinging of the swing member swings prevents occurrence of a toner bridging state in which toner adheres to and grows in the interior of the housing constituting the falling and conveying path. The swing member is swung by a rotational drive shaft and a drive transfer unit formed by an eccentric cam rotating integrally with the rotational drive shaft. The lower end portion of the swing member abuts the eccentric cam, and the rotation of the eccentric cam swings and drives the swing member. At that time, the drive transfer member formed by the eccentric cam is laterally separated from the falling and conveying path at the lower end portion of the swing member. This makes it possible to prevent that toner is sandwiched between the abutment part of the swing member and the eccentric cam, and prevent that the toner is pressed and heated by sliding of the swing member and the eccentric cam, and thus coagulate into lumps.

However, if there is any limitation imposed on the size of a waste toner conveying device, the waste toner conveying device may need to be reduced in size. In such a case, if the swinging drive transfer unit is to be separated from the falling and conveying path as described in Japanese Patent No. 3893232, the falling and conveying path need to be made narrower accordingly. Thus, when the waste toner conveying device is reduced in size, it is difficult to reliably prevent occurrence of toner bridging in the falling and conveying path even if the toner bridging prevention member is disposed in the falling and conveying path.

Therefore, there is a need to provide a waste toner conveying device that, if being reduced in size, reliably prevents occurrence of toner bridging and coagulation in the falling and conveying path of the waste toner conveying path, and an image forming apparatus using the waste toner conveying device.

SUMMARY OF THE INVENTION

It is an object of the present invention to at least partially solve the problem in the conventional technology.

According to an embodiment, a waste toner conveying device for conveying waste toner removed from an image carrier to a waste toner container includes a waste toner conveying path including at least a falling and conveying path for letting the waste toner fall under its own weight; a toner bridging prevention member configured to move in the falling and conveying path to prevent bridging of the waste toner; a drive source configured to drive the toner bridging prevention member; a drive transfer member configured to transfer a driving force from the drive source to the toner bridging prevention member; and a toner adhesion prevention member configured to prevent the waste toner from adhering to the drive transfer member.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
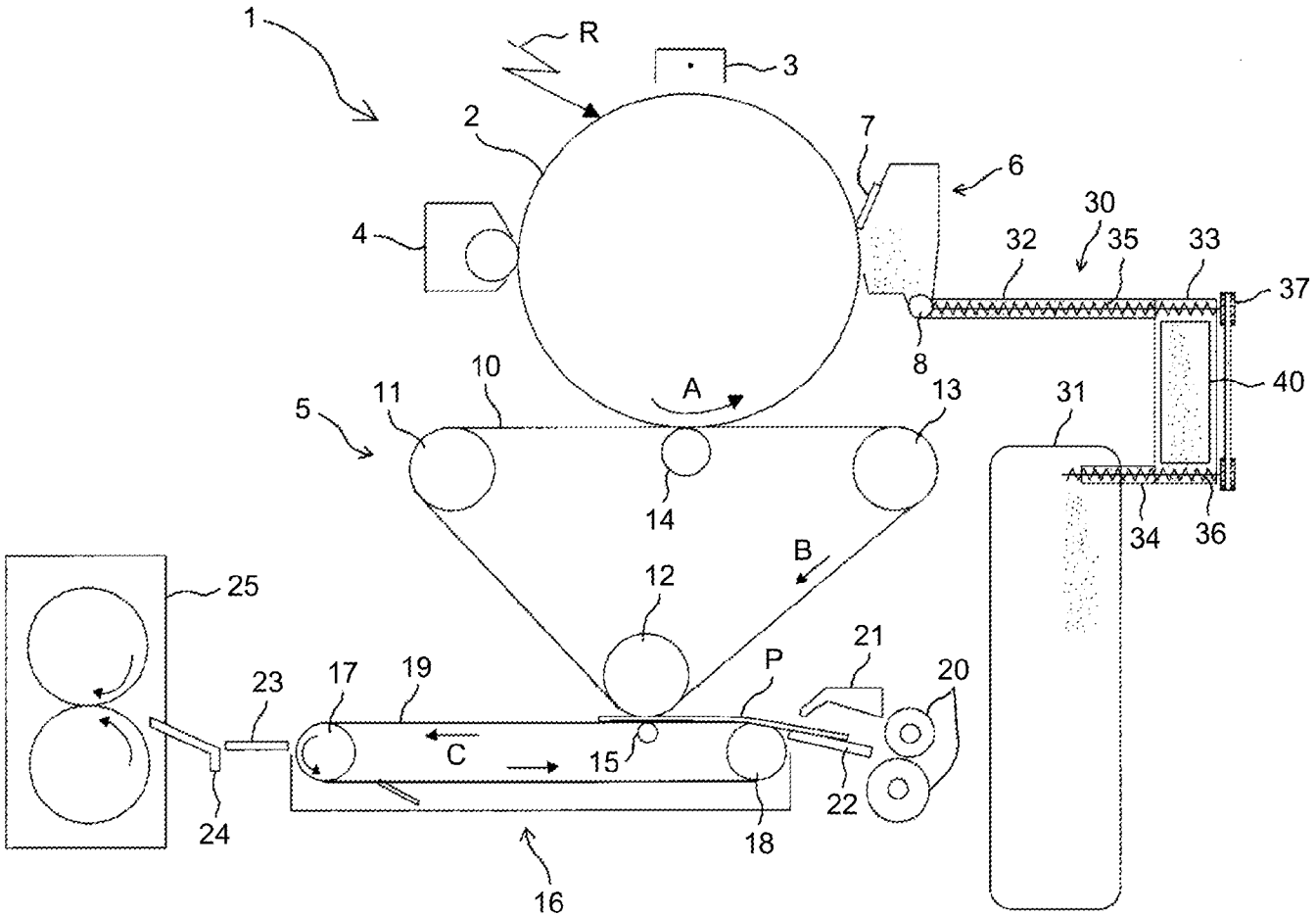
FIG. 1 is a diagram illustrating a configuration of main components of a printer according to an embodiment of the present invention.

An embodiment in which the present invention is applied to a printer as an image forming apparatus will be described below. First, a configuration and operations of the printer according to the embodiment will be described. FIG. 1 is a diagram illustrating a configuration of main components of the printer according to the embodiment. An image forming unit 1 in the printer includes a drum-like photosensitive element 2 as an image carrier rotating in a direction of arrow A in FIG. 1. Arranged around the photosensitive element 2 are: a charging device 3 that evenly charges a surface of the photosensitive element 2; an exposing device not illustrated that exposes the charged surface of the photosensitive element 2 to exposure light R to form an electrostatic latent image; and a developing device 4 that lets toner adhere to the electrostatic latent image for image development. In addition, arranged around the photosensitive element 2 are: a transfer unit 5 that transfers the toner image on the photosensitive element 2 obtained by the image development; a cleaning device 6 that removes residual waste toner from the photosensitive element 2 after the transfer; and a neutralization lamp not illustrated, and the like. The cleaning device 6 includes a cleaning blade 7 that scrapes the residual waste toner off the surface of the photosensitive element 2 after the transfer, a conveying screw 8 that conveys the scraped waste toner in a direction of an axis of the photosensitive element 2, and the like.

The transfer unit 5 includes an intermediate transfer belt 10 that is extended by a plurality of rollers 11, 12, 13, and 14 and is rotated and driven in a direction of arrow B in FIG. 1. The transfer unit 5 forms a primary transfer unit by sandwiching an intermediate transfer belt 10 between the photosensitive element 2 and the primary transfer roller 14 to which a predetermined voltage is applied. The transfer unit 5 also forms a secondary transfer unit by sandwiching the intermediate transfer belt 10 between the secondary transfer backup roller 12 and a secondary transfer roller 15 to which a predetermined voltage is applied.

A paper conveying unit 16 is arranged under the transfer unit 5 as seen in the drawing to convey paper P as a recording medium fed from a paper feeding unit not illustrated. The paper conveying unit 16 is extended by a plurality of rollers 15, 17, and 18 and includes a conveying belt 19 rotating in a direction of arrow C in FIG. 1. Arranged upstream of the paper conveying unit 16 in the paper conveying direction are a pair of registration rollers 20, an upper pre-transfer guide 21, a lower pre-transfer guide 22, and the like. The pair of registration rollers 20 sandwich therebetween the paper P fed from the paper feeding unit not illustrated, and feed the paper P toward the secondary transfer unit at a predetermined timing when the toner image on the intermediate transfer belt 10 reaches the secondary transfer unit. Arranged downstream of the paper conveying unit 16 in the paper feeding direction are a transfer exit guide plate 23, a fixing entrance guide plate 24, a fixing device 25, and the like. The fixing device 25 fixes the unfixed toner image on the paper P by the actions of pressing and heating.

In the printer configured as described above, first, an original image signal read from an original document by an image reading unit not illustrated or an original image signal created by an external computer not illustrated, is input into an image processing unit not illustrated and subjected to appropriate image processing. The thus obtained input image signal is input into an exposing device to modulate the exposure light R. The exposure light R modulated by the input image signal is radiated from the charging device 3 onto the evenly charged surface of the photosensitive element 2. When the exposure light R is radiated onto the surface of the photosensitive element 2, an electrostatic latent image corresponding to the input image signal is formed on the photosensitive element 2. The electrostatic latent image formed on the photosensitive element 2 is developed with toner by the developing device 4 to form a toner image on the photosensitive element 2. The toner image formed on the photosensitive element 2 is transferred to the intermediate transfer belt 10 with application of a transfer bias by the primary transfer roller 14 at the primary transfer unit between the photosensitive element 2 and the primary transfer roller 14 opposed to the photosensitive element 2.

Meanwhile, the paper P fed from the paper feeding unit not illustrated is carried on the paper conveying belt 19 from the pair of registration rollers 20 through between the upper pre-transfer guide 21 and the lower pre-transfer guide 22, and is guided to the secondary transfer unit at a predetermined timing. Then, the toner image on the intermediate transfer belt 10 is transferred to the paper P with application of a transfer bias by the secondary transfer roller 15. The paper P to which the toner image is transferred is guided by the paper conveying belt 19 from the transfer exit guide plate 23 to the fixing entrance guide plate 24, and then is guided to the fixing device 25. The toner image is fixed to the transfer target P transferred to the fixing device 25 by the actions of pressing and heating, and then the paper P is discharged to the outside of the printer.

After the transfer of the toner image to the intermediate transfer belt 10, the photosensitive element 2 is cleared of waste toner by the cleaning device 6 and neutralized by the neutralization lamp not illustrated, and then is evenly charged again by the charging device 3 to repeat the foregoing image forming process. In addition, after the transfer of the toner image to the paper P, the intermediate transfer belt 10 is cleared of waste toner by the belt cleaning device not illustrated, and then repeats an image forming process in which a toner image is transferred from the photosensitive element 2 to the intermediate transfer belt 10 and then transferred to the paper P.

Figure 2:
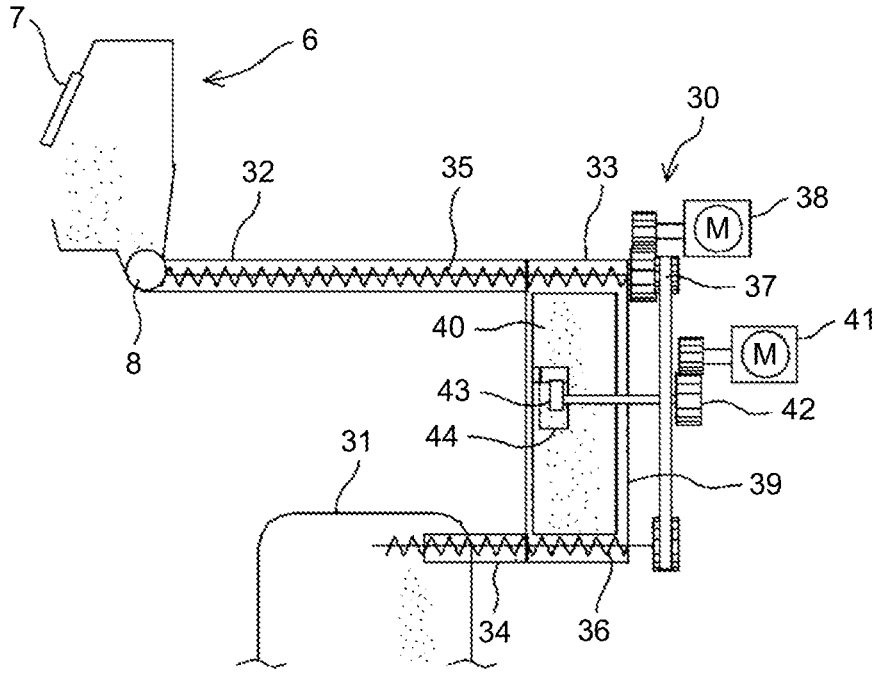
FIG. 2 is a diagram illustrating a schematic configuration of a cleaning device and a waste toner conveying device.
Figure 3:
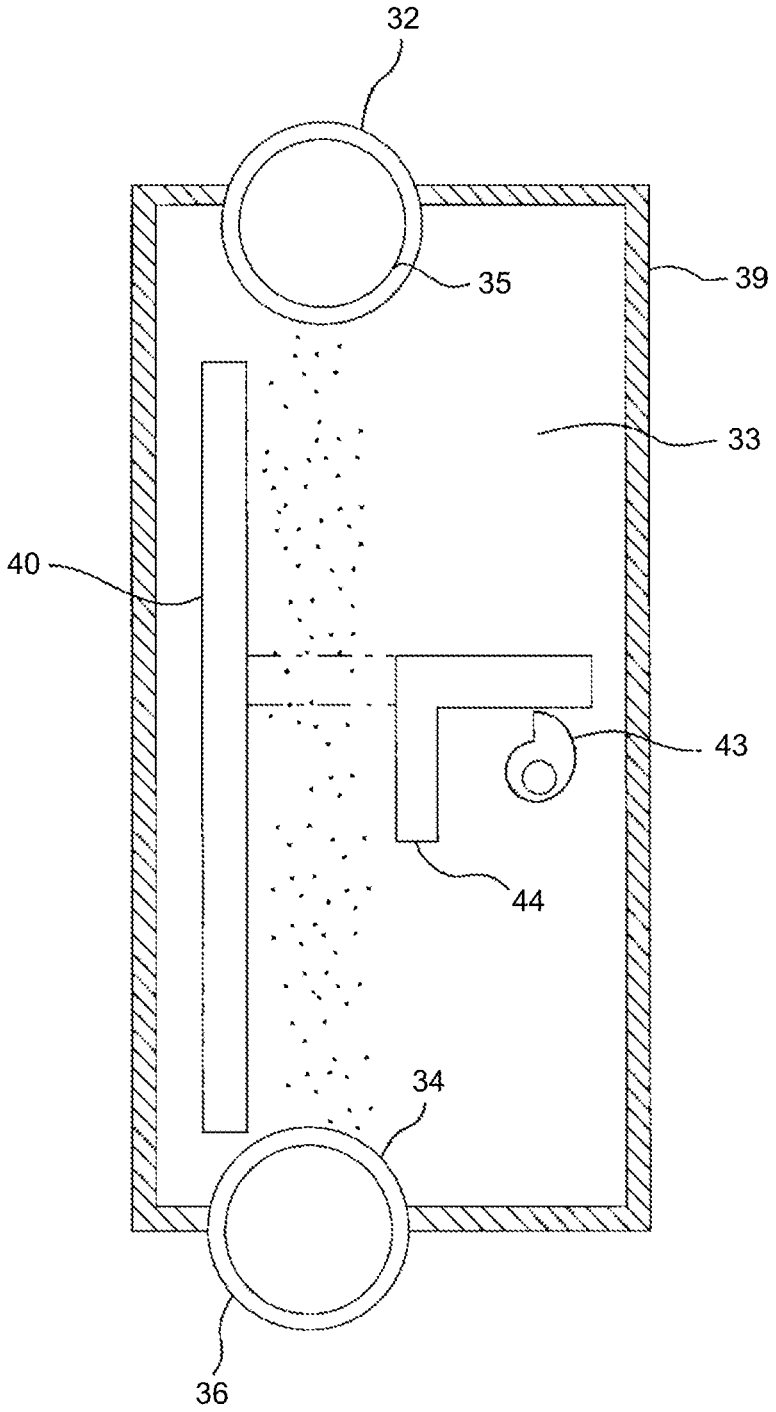
FIG. 3 is a lateral cross section view of a schematic configuration of the waste toner conveying device.
Figure 4:
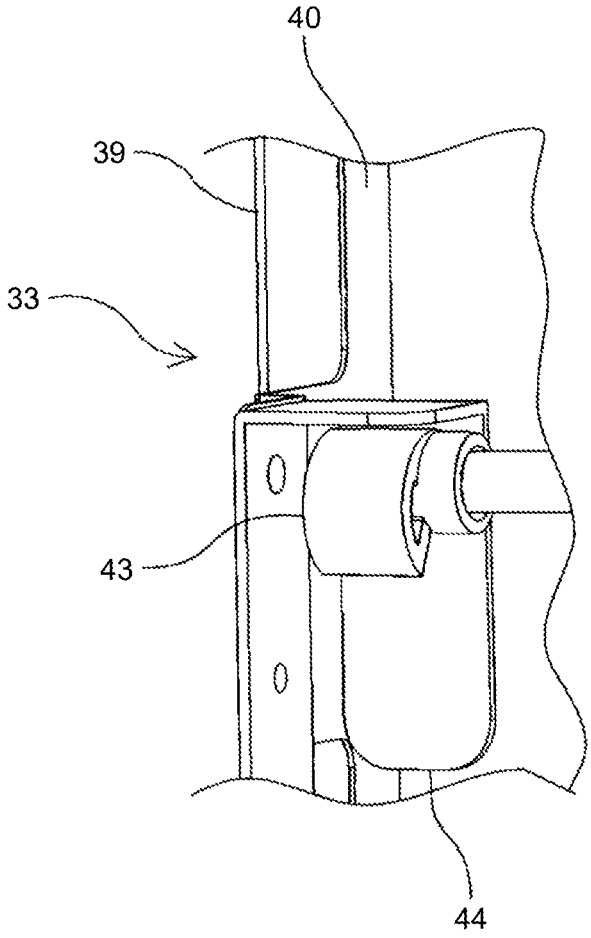
FIG. 4 is a perspective view of a configuration of main components of the waste toner conveying device.

The waste toner removed from the photosensitive element 2 is then removed by the cleaning device 6, and transferred by a waste toner conveying device 30 and collected into a collection bottle 31. FIG. 2 is a diagram illustrating a schematic configuration of the cleaning device and the waste toner conveying device, FIG. 3 is a lateral cross section view of a schematic configuration of the waste toner conveying device, and FIG. 4 is a perspective view of a configuration of main components of the waste toner conveying device. As illustrated in FIG. 2, the waste toner conveying device 30 lets the waste toner collected by a conveying screw 8 of the cleaning device 6 pass through the first conveying path 32, the falling and conveying path 33, and the second conveying path 34 in this order, thereby to collect the waste toner in the collection bottle 31. Arranged in the first conveying path 32 is a conveying screw 35 as a rotational conveying member that conveys the waste toner in a direction orthogonal to the axial direction of the photosensitive element 2 (in the rightward direction as seen in FIG. 2). The waste toner in the first conveying path 32 is transferred by the first conveying screw 35 toward the falling and conveying path 33. The waste toner in the falling and conveying path 33 falls under its own weight in a vertically downward direction. Arranged in the second conveying path 34 is a second conveying screw 36 as a rotational conveying member that conveys the waste toner in the opposite direction of the first conveying screw 35 (in the leftward direction as seen in FIG. 2). The waste toner in the second conveying path 34 is transferred by the second conveying screw 36 toward the collection bottle. The first conveying screw 35 and the second conveying screw 36 are driven by a motor 38 via a geared belt 37.

As illustrated in FIGS. 2 and 3, the waste toner conveying device 30 includes a thin plate-like swing member 40 as a toner bridging prevention member that prevents occurrence of bridging of toner in the falling and conveying path 33. The swing member 40 is swung and driven in a vertical direction as seen in the drawings by a power from the motor 41 as a drive source provided outside of the falling and conveying path 33. The power from the motor 41 is transferred to the swing member 40 via a plurality of gears 42, an eccentric cam 43 as a drive transfer unit, and a toner adhesion prevention member 44.

The swing member 40 is formed in a thin-plate shape and placed at a predetermined space along one side surface wall of a housing 39 constituting the falling and conveying path 33. The swing member 40 is preferably formed by a plate-like material with spring elasticity such as a phosphor bronze plate. However, the swing member 40 may be formed by any other material, for example, iron, stainless steel, copper, or brass, as far as the material has proper spring elasticity.

The eccentric cam 43 is arranged in the falling and conveying path 33 to convert rotating movement of the motor 41 to reciprocating movement and transfer the reciprocating movement to the swing member 40 via the toner adhesion prevention member 44. The eccentric cam 43 may use a stepped eccentric cam to efficiently swing the swing member 40.

As illustrated in FIGS. 3 and 4, the toner adhesion prevention member 44 is formed to have an approximately L-shaped cross section to cover the eccentric cam 43 at the upper side and the toner falling path side. Specifically, the toner adhesion prevention member 44 abuts the eccentric cam 43 by a plane made orthogonal to the toner falling direction to cover the upper side of the eccentric cam 43, and moves in the vertical direction as seen in the drawings by rotation of the eccentric cam 43. The toner adhesion prevention member 44 also has a plane made parallel to the toner falling direction to cover the waste toner falling path side, and uses the plane to block the movement of the waste toner flowing into the eccentric cam 43 while falling in the falling and conveying path 33 under its own weight. As in the foregoing, the toner adhesion prevention member 44 prevents adhesion of the waste toner to the eccentric cam 43. Thus, even when the eccentric cam 43 is arranged in the falling and conveying path 33, the waste toner gets caught in the slide portion between the eccentric cam 43 and the toner adhesion prevention member 44. Accordingly, it is possible to prevent that the toner coagulates into lumps by pressing and heating at the slide portion between the eccentric cam 43 and the toner adhesion prevention member 44 and then the toner lumps breaks the eccentric cam 43.

As illustrated in FIG. 4, the swing member 40 and the toner adhesion prevention member 44 are coupled together at a position not blocking the toner falling path in the vicinity of the side wall of the housing 39 opposite to the side wall on which the gears 42 are arranged. This allows the swing member 40 and the toner adhesion prevention member 44 to be integrally moved. By the rotation of the eccentric cam 43, the swing member 40 and the toner adhesion prevention member 44 swing in the vertical direction. As a result, even if toner bridging occurs in the falling and conveying path 33, the swing member 40 can remove the bridging immediately.

Figure 5:
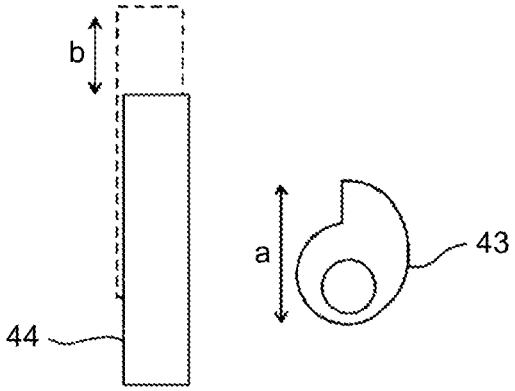
FIG. 5 is a schematic view of a configuration of an eccentric cam and a toner adhesion prevention member in the waste toner conveying device.

As illustrated in FIG. 5, a vertical length of the toner adhesion prevention member 44 is more preferably larger than the sum of a maximum diameter a of the eccentric cam 43 and a swing width b of the toner adhesion prevention member 44 (swing member 40). Accordingly, the toner adhesion prevention member 44 can reliably prevent adhesion of the waste toner to the eccentric cam 43.

As described in Japanese Patent No. 3893232, when the eccentric cam 43 is separated from a gravity center position of the swing member 40, it is conventionally difficult to let the swing member 40 swing vertically in a stable manner because the swing member 40 shakes from side to side or back and forth. Thus, the swing member 40 irregularly contacts the inner wall of the housing 39 constituting the falling and conveying path 33, thereby to cause abrasion of the inner wall of the housing 39.

Thus, in the waste toner conveying device 30 according to the embodiment, a height at which the eccentric cam 43 is placed, that is, a height at which the swing member 40 is supported by the toner adhesion prevention member 44, is almost the same as the height of the gravity center position of the swing member 40. Accordingly, it is possible to let the swing member 40 swing in a stable manner and prevent occurrence of adverse effects such as abrasion of the inner wall of the housing 39.

Figure 6:
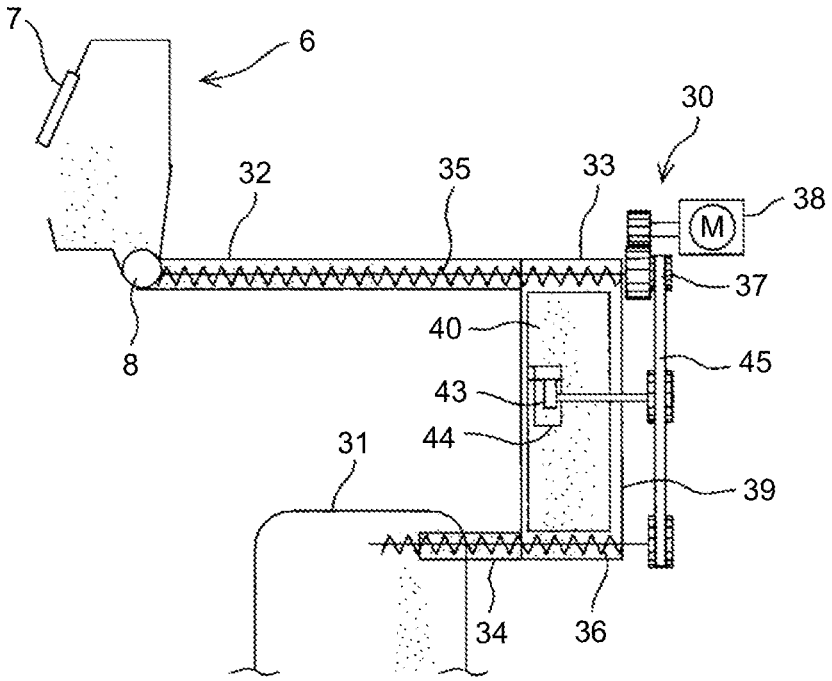
FIG. 6 is a diagram illustrating a schematic configuration of a waste toner conveying device according to another embodiment.

The swing member 40 may be driven directly by the drive unit for the conveying screws 35 and 36, for example. FIG. 6 is a diagram illustrating a schematic configuration of a waste toner conveying device according to another embodiment. In FIG. 6, the same components as those described above are given the same reference signs as those described above, and descriptions thereof are omitted. As illustrated in FIG. 6, the motor 38 coupled to the first conveying screw 35 may be provided with a geared belt 45 or the like, for example, such that a driving force is transferred from the motor 38 to the eccentric cam 43 to swing the swing member 40. By making the drive unit for the swing member 40 identical to the drive unit for the conveying screws 35 and 36, it is possible to eliminate the need to provide the foregoing motor 41 dedicated to the eccentric cam 43, thereby achieving downsizing and cost reduction of the device.

Although no description is given as to a mechanism for reuse of waste toner collected in the collection bottle 31 in the printer according to the embodiment, the printer according to the embodiment may be provided with a waste toner reuse mechanism to supply a mixture of waste toner and new toner to the developing device 4. In addition, although, in the printer according to the embodiment, the waste toner conveying device 30 is placed at the cleaning device 6 removing residual waste toner on the photosensitive element 2, the waste toner conveying device 30 may be placed at the cleaning device for the intermediate transfer belt 10 as an image carrier.

In addition, the printer according to the embodiment is a monochrome printer having one photosensitive element and one developing device 4, but the printer according to the embodiment is not limited to this. The printer according to the embodiment may be a color printer in which various color toner images are formed in sequence on one photosensitive element and the color toner images on the photosensitive element are overlapped and transferred to the intermediate transfer body or paper. Alternatively, the printer according to the embodiment may be a tandem color printer in which a plurality of sets of image forming units including photosensitive elements is arranged, toner images of different colors are formed on the photosensitive elements of the image forming units, and the toner images on the photosensitive elements are overlapped and transferred to the intermediate transfer body or paper.

The foregoing embodiment is one example, and the present invention produces advantages specific to aspects described below.

Aspect A

A waste toner conveying device configured to convey waste toner removed from an image carrier such as the photosensitive element 2 to a waste toner container such as the collection bottle 31, includes: a waste toner conveying path that includes at least a falling and conveying path such as the falling and conveying path 33 letting the waste toner fall under its own weight; a toner bridging prevention member such as the swing member 40 that moves in the falling and conveying path to prevent bridging of the waste toner; a drive source such as the motor 41 that drives the toner bridging prevention member; a drive transfer member such as the eccentric cam 43 that transfers a driving force from the drive source to the toner bridging prevention member; and a toner adhesion prevention member such as the toner adhesion prevention member 44 that prevents the waste toner from adhering to the drive transfer member.

According to the foregoing mode, as described above in relation to the embodiment, it is possible to prevent waste toner from adhering to the drive transfer member by providing the toner adhesion prevention member. It is thus possible to prevent that waste toner adheres to the drive transfer unit to deteriorate functionality of the drive transfer unit and cause a malfunction of the toner adhesion prevention member. There is thus no need to provide a space for placement of the drive transfer unit other than in the falling and conveying path to avoid adhesion of toner to the drive transfer unit. This makes it possible to secure a space in the falling and conveying path even if the waste toner conveying device is reduced in size. That is, even if the waste toner conveying device is reduced in size, it is possible to reliably prevent occurrence of toner bridging in the falling and conveying path by the toner bridging prevention member.

Aspect B

In the waste toner conveying device in Aspect A, the drive transfer member is an eccentric cam that converts rotating movement transferred from the drive source to reciprocating movement.

According to this, as described above in relation to the embodiment, it is possible to reduce a space occupied by the drive transfer member with the use of the eccentric cam as drive transfer member.

Aspect C

The waste toner conveying device in Aspect A or B includes rotational conveying members such as the conveying screws 35 and 36 that are rotated and driven to convey toner.

According to this, as described above in the embodiment, it is possible to convey waste toner collected by the cleaning device or the like to a desired position by the rotational conveying member.

Aspect D

In the waste toner conveying device in Aspect C, the drive source for rotating and driving the drive transfer member and the rotational transfer member is one and the same.

According to this, as described above in relation to the embodiment, it is possible to reduce the device in size as compared to the case of providing separate drive sources.

Aspect E

In the waste toner conveying device in Aspect A, B, C, or D, the drive transfer member is placed at a height close to the gravity center position of the toner bridging prevention member.

According to this, as described above in relation to the embodiment, the swing motion of the toner bridging prevention member is stable as compared to the case of separating the drive transfer member from the gravity center position of the toner bridging prevention member. Accordingly, it is possible to prevent abrasion of the housing resulting from contact of the toner bridging prevention member with the housing, and the like.

Aspect F

In the waste toner conveying device in Aspect A, B, C, D, or E, the toner adhesion prevention member is placed nearer the drive transfer member than the falling position of the waste toner in the falling and conveying path.

According to this, as described above in relation to the embodiment, it is possible to avoid the toner adhesion prevention member from blocking the falling and conveying path.

Aspect G

In the waste toner conveying device in Aspect A, B, C, D, E or F, the vertical length of the toner adhesion prevention member is larger than the sum of the maximum vertical length of the drive transfer member and the movable distance of the toner bridging prevention member.

According to this, as described above in relation to the embodiment, by setting the vertical length of the toner adhesion prevention member equal to or larger than a predetermined length, it is possible to reliably prevent the waste toner from adhering to the drive transfer member.

Aspect H

In an image forming apparatus including: an image carrier such as the photosensitive element 2; a transfer unit such as the transfer unit 5 that transfers toner on the image carrier to a transfer target such as the intermediate transfer belt 10; a cleaning unit such as the cleaning device 6 that removes residual waste toner from the image carrier after the transfer by the transfer unit; and a waste toner conveying unit such as the waste toner conveying device 30 that conveys the waste toner removed by the cleaning unit to a waste toner container, wherein the waste toner conveying unit is the waste toner conveying device in Aspect A, B, C, D, E, F, or G.

According to this, as described above in relation to the embodiment, even if the device is reduced in size, it is possible to reliably prevent occurrence of toner bridging or coagulation in the falling and conveying path of the waste toner conveying path.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A waste toner conveying device for conveying waste toner removed from an image carrier to a waste toner container, the waste toner conveying device comprising:

a conveying member configured to provide a waste toner conveying path including at least a falling and conveying path for letting the waste toner fall under its own weight;

a toner bridging prevention member configured to move in the falling and conveying path to prevent bridging of the waste toner;

a drive source configured to drive the toner bridging prevention member;

a drive transfer member configured to transfer a driving force from the drive source to the toner bridging prevention member; and a toner adhesion prevention member configured to prevent the waste toner from adhering to the drive transfer member, wherein the drive transfer member is an eccentric cam located in the falling and conveying path for converting rotating movement transferred from the drive source to reciprocating movement.

2. The waste toner conveying device according to claim 1, further comprising a rotational conveying member configured to convey toner through rotation, the rotational conveying member being included in the waste toner conveying path.

3. The waste toner conveying device according to claim 2, wherein the drive transfer member and the rotational conveying member are configured to share a driving source for rotation and driving.

4. The waste toner conveying device according to claim 1, wherein the drive transfer member is arranged at a height near a gravity center position of the toner bridging prevention member.

5. The waste toner conveying device according to claim 1, wherein the toner adhesion prevention member is arranged nearer the drive transfer member than the falling position of the waste toner in the falling and conveying path.

6. The waste toner conveying device according to claim 1, wherein a vertical length of the toner adhesion prevention member is larger than the sum of a maximum vertical length of the drive transfer member and a movable distance of the toner bridging prevention member.

7. An image forming apparatus, comprising:

an image carrier;

a transfer unit configured to transfer toner on the image carrier to a transfer target;

a cleaning unit configured to remove residual waste toner on the image carrier after the transfer by the transfer unit; and a waste toner conveying device according to claim 1, configured to convey the waste toner removed by the cleaning unit to a waste toner container.

8. The waste toner conveying device according to claim 1, wherein the toner bridging prevention member is a thin-plate member.

9. The waste toner conveying device according to claim 1, wherein the toner bridging prevention member is placed at a predetermined space along one side surface wall of a housing constituting the falling and conveying path.

10. The waste toner conveying device according to claim 1, wherein the driving force from the drive source is transferred to the toner bridging prevention member via a plurality of gears, the eccentric cam, and the toner adhesion prevention member.

11. The waste toner conveying device according to claim 10, wherein the eccentric cam is arranged in the falling and conveying path to convert rotating movement of the drive source to reciprocating movement and transfer the reciprocating movement to the toner bridging prevention member via the toner adhesion prevention member.

12. The waste toner conveying device according to claim 10, wherein the toner adhesion prevention member is formed to have an approximately L-shaped cross section to cover the eccentric cam at an upper side and the toner falling path side.

13. The waste toner conveying device according to claim 10, wherein the toner adhesion prevention member abuts the eccentric cam in relation to a plane made orthogonal to the toner falling direction to cover the upper side of the eccentric cam, and moves in a vertical direction by rotation of the eccentric cam.

14. The waste toner conveying device according to claim 10, wherein the toner adhesion prevention member has a plane made parallel to the toner falling direction to cover the waste toner falling path side, and uses the plane to block the movement of the waste toner flowing into the eccentric cam while falling in and in the conveying path under its own weight.

15. The waste toner conveying device according to claim 10, wherein the toner bridging prevention member and the toner adhesion prevention member are coupled together at a position not blocking the toner falling path in a vicinity of the side wall of the housing opposite to the side wall on which the gears are arranged thereof.

16. The waste toner conveying device according to claim 1, wherein the drive source swingably drives the toner bridging prevention member in a vertical direction with respect to an image forming device.

* * * * *